US005992640A

United States Patent [19]

Clark et al.

[11] Patent Number: 5,992,640

[45] Date of Patent: Nov. 30, 1999

[54] PRECIOUS METALS RECOVERY FROM ORES

[75] Inventors: David William Clark; Andrew Newell, both of Chatswood, Australia

[73] Assignee: BOC Gases Australia Limited, Chatswood, Australia

[21] Appl. No.: 08/928,422

[22] Filed: Sep. 12, 1997

Related U.S. Application Data

[63] Continuation of application No. 08/558,395, Nov. 16, 1995, abandoned.

[30] Foreign Application Priority Data

Nov. 16, 1994 [AU] Australia ..... PM9538

[51] Int. Cl.[6] ..... B03D 1/06; B03D 1/02; B03D 1/002; B03D 1/018

[52] U.S. Cl. ..... 209/166; 209/167; 241/19; 241/20; 241/24.13; 241/24.25

[58] Field of Search ..... 209/166, 167; 241/19, 20, 24.13, 24.25

[56] References Cited

U.S. PATENT DOCUMENTS

| | | |
|---|---|---|
| 1,728,352 | 9/1929 | Lowe . |
| 1,869,532 | 8/1932 | Weinig . |
| 1,893,517 | 1/1933 | Gaudin . |
| 1,973,558 | 9/1934 | Brinker . |
| 3,137,649 | 6/1964 | De Benedictis . |
| 3,202,281 | 8/1965 | Weston . |
| 3,503,499 | 3/1970 | Allegrini et al. . |
| 4,561,970 | 12/1985 | Heimala et al. . |
| 4,816,234 | 3/1989 | Brison et al. . |
| 5,068,028 | 11/1991 | Miller et al. . |
| 5,110,455 | 5/1992 | Huch . |
| 5,171,428 | 12/1992 | Beattie et al. . |

FOREIGN PATENT DOCUMENTS

| | | |
|---|---|---|
| 56300/94 | 9/1994 | Australia . |
| 1104274 | 6/1981 | Canada . |
| 1238430 | 6/1988 | Canada . |
| 146899 | 3/1981 | Germany . |
| 56-141856 | 11/1981 | Japan . |
| 524108 | 7/1983 | Spain . |
| 385621 | 6/1973 | U.S.S.R. . |
| 2086768 | 5/1982 | United Kingdom . |
| 93/22060 | 11/1993 | WIPO . |

OTHER PUBLICATIONS

Taggart, "Handbook of Mineral Dressing", New York, Wiley (1945) pp. 2–67.

Abstract of Soviet Union Patent No. 692623–A dated Oct. 25, 1979.

Abstract of Soviet Union Patent No. 405247–A dated Dec. 10, 1974.

Taggart, AF, "Handbook of Mineral Dressing", New York, Wiley (1945), pp. 12–33.

Taggart, AF, "Handbook of Mineral Dressing", New York, Wiley (1954) pp. 2–65, 2–66.

Arthur F. Taggart, "Handbook of Mineral Dressing", pp. 12–117 to 12–118 (1945); John Wiley & Sons,—NY.

True copy of Provisional Specification, "Improvements to Flotation Processing", pp. 1–4.

B.A. Wills, "The Separation by Flotation of Copper–Lead–Zinc Sulphides," *Mining Magazine,* pp. 36–41 (Jan. 1984).

*Primary Examiner*—Thomas M. Lithgow

*Attorney, Agent, or Firm*—Burns, Doane, Swecker & Mathis, L.L.P.

[57] ABSTRACT

A process for recovery of a precious metals containing mineral from a non-sulphidic gangue mineral comprising:

preparing a pulp of a material containing the precious metals containing and gangue minerals;

conditioning the pulp with an oxidizing gas containing a gas selected from oxygen and ozone; and subjecting the conditioned pulp to a flotation operation for recovery of the precious metals containing mineral.

34 Claims, No Drawings

PRECIOUS METALS RECOVERY FROM ORES

This application is a continuation of application Ser. No. 08/558,395, filed Nov. 16, 1995 now abandoned.

FIELD OF THE INVENTION

The present invention relates to the separation of minerals by froth flotation. More particularly, the invention relates to a process for separating precious metals containing minerals from non-sulphide minerals.

BACKGROUND OF THE INVENTION

Precious metal containing ores treated for recovery of gold and other precious metals are increasingly of the so-called refractory type in which a sulphide mineral contains freely, or in association, a precious metals constituent. The sulphide mineral, often of the pyrite or iron sulphide variety-though other base metal sulphides may be present, may then occur in association with a gangue mineral. In addition to these components the ore may also contain species such as tellurides.

By "refractory" is meant that the ore is intractable to treatment by direct cyanide or other leaching processes. The intractability may vary in degree thus ores may be said to be partially refractory. In the most severe cases, no economically significant degree of gold recovery is achieved and the ore is said to be fully refractory. For example, where ore grains consist mainly of pyrite encapsulated gold, the ore may be especially difficult to treat by direct leaching and may be fully refractory.

Lanyon, M. and Floyd, J M, "Recovery of Gold from Refractory Ores and Concentrates using the Sirosmelt Reactor", Research and Development in Extractive Metallurgy AusIMM Conference, Adelaide 1987 discloses the difficulties in treating such ores. For example, if the sulphide mineral is, for example, pyrite or another iron sulphide mineral direct cyanidation becomes expensive to the point of becoming uneconomic.

Therefore, in an effort to avoid the need for roasting plant followed by hydrometallurgical recovery of gold, Floyd proposes a direct smelting process for the treatment of such ores in which a matte phase containing the precious metals component is formed in a Sirosmelt reactor. From the low grade matte, the precious metals may be recovered by use of a collector such as copper, lead or iron.

Pyrometallurgical routes are unlikely to be economic because of the very large volume of material that must be treated due to the low grade of the ore.

Therefore, a technique is required that will enable the precious metals component to be recovered in as inexpensive and efficient a manner as possible and this mandates the recovery of the usually sulphide or telluride component by some means of concentration.

Bacterial leaching techniques may be employed to solubilise a sulphide mineral, thereby liberating the precious metals component for recovery of the precious metals by cementation or other electrochemical techniques. However, rate of solubilisation, high temperatures and lack of water may make this an unsuitable technique in many situations.

Flotation is used in the treatment of refractory/partially refractory auriferous material to separate gangue minerals and produce a significantly smaller volume of concentrate for further processing. The overall gold recovery is most dependent upon the first stage process recovery; in this case, flotation. Therefore, the degree of recovery from flotation and grade of the flotation concentrate are desired to be as high as economically and technically feasible in order to ensure viability of material treatment for gold and other precious metals recovery.

SUMMARY OF THE INVENTION

It is the object of the present invention to provide a process for treatment of ores containing precious metal containing minerals in association with non-sulphide gangue minerals which enables better recovery of the precious metal containing minerals with more desirable economics than provided by techniques heretofore used.

With this object in view, the present invention provides a process for recovery of a precious metals containing mineral from a non-sulphidic gangue mineral comprising:

- preparing a pulp of a material containing the precious metal containing and gangue minerals;
- conditioning the pulp with an oxidising gas containing a gas selected from oxygen and ozone; and
- subjecting the conditioned pulp to a flotation operation for recovery of the precious metals containing mineral.

Generally, the precious metal containing mineral will be a sulphide mineral. The sulphide mineral may be a member of the iron sulphide family such as pyrite, pyrrhotite or marcasite. Alternatively, at least a portion of the iron in the iron sulphide may be substituted by elements such as arsenic (arsenopyrite) and copper and/or nickel (pentlandite). Copper and other base metal sulphides may also be present though not generally as minerals of primary economic significance. In addition, other components such as tellurides may be present. It may be that some ore types contain pyrite or other iron sulphide minerals in association with arsenopyrite. Where iron sulphide (pyrite): arsenopyrite ratio falls below about 2 it may be found that the arsenopyrite is depressed. This effect may be used as the basis for recovery of arsenopyrite as a tail which may be subject to further processing for precious metals recovery therefrom.

The precious metals containing mineral may contain free gold or other precious metals. Alternatively, the atomic lattice of an iron sulphide mineral, say pyrite, may have some iron displaced by the gold such that the gold occurs in mineralised form. Both types of gold occurrence are intended to be within the scope of the disclosure.

The non-sulphide mineral may be a siliceous mineral, a carbonate or any other host mineral having non-sulphide mineralogy. Typically, the non-sulphide mineral may be quartz.

The oxidising gas may be selected from oxygen, ozone, ozonated air or ozonated oxygen. The gas may usefully contain a substantial proportion, even a major proportion, of oxygen i.e. in a concentration greater than that present in air. Without wishing to be bound by any theory, the presence of an oxidising gas is suspected to activate the surfaces of sulphide mineral grains. By "activate" is meant that the sulphide mineral surfaces are made more susceptible to bonding with a collector than would be the case if air was used as the conditioning gas. Activation may be assisted by relatively high solubility of the oxidising gas and, accordingly, air-having low oxygen solubility—is somewhat disadvantageous. Nonetheless, it is to be understood that the duration of oxidative conditioning must be controlled as over-oxidation may create difficulties in terms of less efficient collector usage in at least two ways. The collector itself may be destroyed which is most undesirable or the mineral surface made even less susceptible to bonding with the collector than would ordinarily be the case. It follows that if such a mechanism is at play, oxidising gas ideally comes into contact with the mineral no earlier than milling of an ore to a particle size for processing where fresh sulphide surfaces are exposed initially.

The conditioning step may occur prior to flotation or simultaneously therewith. The former strategy is preferred because deleterious components, such as sulphoxy compounds and especially thiosulphate, in the pulp may be destroyed by a pre-oxidation step prior to the addition of collectors, activators and other flotation reagents.

There is no need for the conditioning step to occur in a single stage. For example, the oxidising agent may be introduced in a preliminary conditioning stage. The remaining flotation reagents may then be added in a secondary conditioning stage. Thus oxidising agent and other flotation reagents may be introduced in discrete conditioning or other stages. It is not intended here to limit the conditioning stage to two banks of conditioning cells. It is intended to illustrate that the introduction of flotation reagents to the circuit may occur in a number of ways promoting the efficiency of the process.

A preliminary oxidation step wherein the oxidising gas is introduced at the mill, where fresh sulphide surfaces may be generated which are most susceptible to activation, or in a primary conditioning stage is advantageous in that, by consuming deleterious components such as abraded iron, poly sulphides and sulphoxy species, undesirable consumption of flotation reagents is avoided and improved activation of the sulphide minerals is consequently achieved. Oxidising gas may also be introduced to the pulp on discharge of the pulp from milling or prior to addition of other flotation reagents, e.g. collectors, frothers etc.

It may be that a preliminary oxidation step has the benefit of enabling a certain oxygen uptake by the pulp including the liquor and the sulphide minerals and it is noted that the water used to make up a pulp may have an oxygen demand thereby activating them and making the sulphide mineral surfaces more amenable to bonding with the collector but it is not desired to be bound by any theory in this respect.

Where the collector is a xanthate such as sodium ethyl xanthate, potassium amyl xanthate, sodium isobutyl xanthate, sodium isopropyl xanthate or sodium secondary butyl xanthate, the addition of the oxidising gas may promote dixanthogen formation and improved sulphide mineral recovery.

In this regard, the addition of the oxidising gas may also be used to advantage to achieve a more stable oxidation-reduction potential in the pulp. Ordinarily, the oxidation-reduction potential of mill product is highly variable. Addition of oxidising gas has a significant effect on oxidation-reduction potential and therefore exerts a buffering effect on the potential. Addition of the oxidising gas may be controlled in accordance with, or to maintain, a desired range of oxidation-reduction potential (ORP) for conditioning. The desired range of ORP may be determined for each specific ore type by trial and error.

Addition of other flotation reagents may be linked to the determined optimal oxidation-reduction potential or potential range allowing optimisation of the flotation process. It is important to observe that elevated pulp oxidation-reduction potential assists in the maximisation of xanthate collection ability.

The appropriate conditioning duration may depend upon a number of factors such as pulp electrochemical or oxidation-reduction potential; whether the conditioning is a batch or continuous process and the desirability of avoiding over-oxidation of the pulp. Generally, the optimal results in terms of conditioning will be achieved with not longer than 60 minutes conditioning, preferably less than 20 minutes conditioning and preferably 3 to 12 minutes.

The optimum oxygen addition rate and pulp saturation may be determined for each specific ore type by trial and error. For example, the maintenance of a dissolved oxygen concentration of 6 to greater than 30 mg/l pulp liquor for a period of 3 to 12 minutes may prove effective for many ore types but preliminary testing is advisable.

The total dissolved solids concentration of water employed for pulping of the material containing the precious metals containing mineral and the non-sulphide gangue material may also be a relevant variable. It has been found that oxygen saturation in water having a high total dissolved solids concentration falls and this factor may be taken into account in processing.

The process may be carried out in different sequences than above described. For example, a preliminary conditioning stage could be followed by flotation. The tail could then be subjected to a secondary oxidative conditioning process as above described. The process can be continued in such a manner and in such a number of stages as is economically feasible.

Following recovery of the flotation concentrate which bears the precious metals component being especially gold but also silver, platinum and palladium, this concentrate can be treated in any conventional manner. For example, the concentrate can be roasted and cyanide leached, treated for pyrometallurgical recovery by direct smelting or any other economically feasible technique.

By following the process disclosed herein a greater recovery of precious metals may be achieved at lower reagent cost than previously experienced. In addition, by reducing the precious metals content of the beneficiation plant tails, the need to provide a secondary leaching plant to treat the tails may be avoided. The advantages so obtained make flotation concentration of the precious metals containing mineral a more preferable treatment option than previously recognised.

Reduction of the sulphur content associated with precious metals in the tail may also have environmental benefits due to reduction of acid drainage type effects. Also, better recovery of the precious metals in the flotation stage will avoid the need for a tailings leach treatment. As commonly employed, leaching technology involves the use of cyanide; avoidance of the cyanide leaching step also has environmental benefits in terms of reducing environmental exposure to cyanide.

DETAILED DESCRIPTION OF THE INVENTION

The invention will be better understood from the following detailed description of a preferred embodiment thereof made with reference to the appended examples.

The process as above described may be implemented in a plant which treats a refractory precious metals containing sulphide/telluride ore. The key precious metal recovered in the plant is gold. Treatment yields a gold/sulphide flotation concentration from which gold bullion may be recovered.

Many of the steps in the precious metals recovery process are conventional and understood readily by those skilled in the art. The process commences with ore crushing and milling in a ball or rod mill. Milled ore pulp formed by mixing crushed ore with water is then subjected to conditioning and flotation steps or with and without implementation of the invention which was conducted on a laboratory scale in accordance with the following steps:

1. 1 kg of crushed ore was ground to a $P_{80}$ of 106 microns in a pulp containing process water. Milling was conducted in stainless steel and mild steel rod mills.
2. The pulp was transferred to a conventional 2.5 liter laboratory flotation cell and diluted to 35 percent by weight solids.
3. 10 to 35, preferably 20, g/t $CuSO_4$ was added to activate the sulphide mineral and conditioning was conducted for a period of 2 minutes with agitation by an agitator rotating at 900 rpm.
4. Sodium ethyl xanthate (6 to 20, preferably 15, g/t ore) as collector was then added and conditioning followed for an additional period of 2 minutes.
5. A triethyloxy butane type frother sourced under the trade name Interfroth 50® (IF5°) was then added in a quantity of 10 g/t ore and conditioning continued for a further period of 1 minute. Other frothers such as carbinols could also be used in place of the frother used in the tests.

Incidentally, higher additions of frother may be required where the process water is less saline than that used in the tests. Saline water seems to assist the frothing process. The water used in the tests was hypersaline, that is, had greater salinity than seawater.

6. Concentrates were then recovered as rougher concentrates at 1, 2, 4 and 6 minutes.
7. To the tail of the fourth concentrate was added sodium ethyl xanthate (3 g/t) and flotation conducted in a scavenger mode.

The process of the invention was implemented in the following manner:

1. Oxygen was introduced by sparging into the cell at preset flow rates, 1.5 l/min, for predetermined amounts of time.
2. Agitator speed was set at the minimum level to suspend the ore solids and minimise turnover of the slurry surface.
3. After preset duration of addition of oxygen, oxygen flow was discontinued and agitation continued at low speed for a further 2 minutes. Measurements of electrochemical potential vs standard calomel electrode, dissolved oxygen, pH and temperature were electronically recorded.
4. Agitator speed was increased to 900 rpm and reagent conditioning or flotation commenced as appropriate.

The ore tested in accordance with the above procedures assayed less than 2.2 g/t gold and greater than 1.5% by weight sulphur.

The following data were obtained for comparative and illustrative tests in accordance with the above procedure. Results are provided on the basis of the composite concentrate recovered from a flotation cell operated in multistage rougher mode.

| | | Overall Concentrate | | | |
|---|---|---|---|---|---|
| | Oxygen Addition Duration ($O_2$ @ | Gold | | Sulphur | |
| Example | 1.5 l/min) [min] | Grade (g/t) | Recovery (%) | Grade (%) | Recovery (%) |
| 1 | 1 | 21.7 | 90.5 | 14.6 | 96.2 |
| 2 | 7 | 27.9 | 91.7 | 14.0 | 93.2 |
| 3* | 0 | 17.8 | 89.2 | 14.1 | 93.2 |

*(Comparative Example)

The tail assayed gold and sulphur as tabulated below:

| Oxygen Addition Duration ($O_2$ @ Addition 1.5 l/min) [min] | Gold Grade (g/t) | Sulphur Grade (%) |
|---|---|---|
| 1 | 0.237 | 0.06 |
| 7 | 0.272 | 0.11 |
| 0 | 0.260 | 0.11 |

The data generally illustrate a higher precious metal recovery for the process of the invention as compared with conventional flotation as demonstrated by Comparative Example 3. However, there may be some optimum conditioning time range outside which oxidative conditioning does not produce as obvious a benefit in terms of grade and recovery.

An increase in precious metals recovery, as measured on a sulphur basis, from 93.2 to 96.8% is appreciable in revenue terms.

In each of the above tests, the redox potential was measured on the basis of platinum electrode versus calomel electrode and ore tabulated thus:

| Example | Oxidation-Reduction Potential (Prior to Flotation) [MV] |
|---|---|
| 1 | +141 |
| 2 | +127 |
| 3 (Comparative) | −209 |

The oxidation-reduction potential is significantly higher in the case of oxygen addition.

Further tests were conducted with five ore types A,B,C, D,E with general mineralogical characterisation as follows:

Ore

A Sulphide (pyrite)/Non-Sulphide (Quartz (Q), Feldspar (F), Ankerite (A), Chlorite (CC), Muscovite (M), Magnetite (MA)

B Sulphide (pyrite)/Non-Sulphide (Q,M,F, potash, albite (AL), dolomite (D))

C Sulphide (pyrrhotite, arsenopyrite)/Non-Sulphide (Q,AL, CL, calcite (CA), amphibole, ilmenite)

D Sulphide (pyrite, arsenopyrite)/Non-Sulphide (Q,AL,M, CL,CA,D goethite)

E Sulphide (pyrite, arsenopyrite)/Non-Sulphide (Q,AL,M, CL,CA, siderite) to assess the effect of iron sulphide: arsenopyrite ratio on flotation behaviour.

The test procedure was similar to that described above and relevant data is summarised in the table below:

| PARAMETER | ORE A | ORE B | ORE C | ORE D | ORE E |
|---|---|---|---|---|---|
| GRIND (p80,μm) | 106 | 106 | 90 | 75 | 106 |
| Media | MS/SS | MS | MS | MS | MS |
| FLOAT CELL (I) | 2.5 | 2.5 | 2.5 | 2.5 | 2.5 |
| RPM | 900 | 1000 | 1000 | 1000 | 1000 |
| % SOLIDS | 40 | 35 | 35 | 35 | 35 |
| REAGENT DETAILS: (g/t, Conditioning Period) | | | | | |
| (1) Copper Sulphate | 20,2 | 50,2 | 50,2 | 60,2 | 50,2 |
| (2) Collector | SEX:15,2 >C4:3,1 | SIPX:25,2 >C2:25,2 | PAX:40,2 >C3:40,2 AP238:20,2 >C3:20,2 | PAX:50,2 >C2:50,2 | SEX:50,2 >C2:25,2 AP238:25,2 |
| (3) Frother | IF50:10,1 | DOW400:10,1 >C3:10,1 >C4:10,1 | IF50:20,1 >C3:10,1 | IF50:10,1 >C2:10,1 >C4:20,1 | IP50:10,1 >C2:10,1 >C5:10,1 |
| (4) Other | | | | Lime 250 | |
| Concentrate Removal Times (min) | 1,2,4,6 | 0.5,1,2,4,8 | 0.5,1,2,48 | 0.5,1,2,4,8 | 0.5,1,2,4,8 |

Legend.
MS — mild steel
SS — stainless steel
With respect to reagent details the first figure is addition of reagent (g/t ore) and the second figure is the conditioning time (minutes)
AP238 is a dithiophosphate collector.

| ORE TYPE | PROCESS WATER TDS (mg/l) | GRADE GOLD (g/t) | GRADE SULPHUR (%) | SULPHIDE MINERAL RATIO IRON SULPHIDE: ARSENOPYRITE | EFFECT ON OXYGENATION ON PRECIOUS METAL RECOVERY BY FLOTATION |
|---|---|---|---|---|---|
| A | 95 000 | 1.8 | 1.7 | 136 | Improvement |
| B | 200 000 | 3.2 | 1.3 | 44.3 | Improvement |
| C | 65 000 | 1.6 | 0.7 | 13.6 | Improvement |
| D | 950 | 5.0 | 1.3 | approx 1.6 | Negligible |
| E | 950 | 1.5 | 0.4 | approx 1.4 | Arsenopyrite |
| Local Water | 300 | — | — | — | Depressed |

| | OXYGENATION HISTORY | | CONCENTRATE 1 GOLD | | CONCENTRATE 1 SULPHUR | | OVERALL CONCENTRATE GOLD | | OVERALL CONCENTRATE SULPHUR | | |
|---|---|---|---|---|---|---|---|---|---|---|---|
| ORE TYPE | D.O. (ppn) | Time (min) | Grade (g/t) | Recovery (%) | Grade (%) | Recovery (%) | Grade (g/t) | Recovery (%) | Grade (%) | Recovery (%) | COMMENT |
| (A) | — | — | 49.8 | 44.2 | 37.5 | 43.9 | 17.8 | 89.2 | 14.i | 93.2 | Standard: Process Water |
| | 15 | 1 | 63.0 | 49.0 | 37.5 | 46.3 | 21.7 | 90.5 | 14.6 | 96.2 | Process Water |
| | >30 | 3 | 52.5 | 52.4 | 36.7 | 53.0 | 17.5 | 88.7 | 13.2 | 96.8 | Process Water |
| | >30 | 5 | 54.0 | 49.4 | 38.5 | 51.4 | 19.3 | 88.9 | 14.3 | 96.2 | Process Water |
| | >30 | 7 | 73.5 | 45.3 | 36.5 | 45.5 | 27.9 | 91.7 | 14.0 | 93.2 | Process Water |

| | OXYGENATION HISTORY | | CONCENTRATE 1 | | | | OVERALL CONCENTRATE | | | | |
|---|---|---|---|---|---|---|---|---|---|---|---|
| | | | GOLD | | SULPHUR | | GOLD | | SULPHUR | | |
| ORE TYPE | D.O. (ppn) | Time (min) | Grade (g/t) | Recovery (%) | Grade (%) | Recovery (%) | Grade (g/t) | Recovery (%) | Grade (%) | Recovery (%) | COMMENT |
| (B) | — | — | 93 | 43.5 | 39.8 | 51.7 | 38.4 | 83.7 | 16.1 | 97.5 | Standard: Local Water |
| | — | — | 52.8 | 56.2 | 23 | 62.4 | 22.8 | 84.7 | 9.3 | 87.8 | Standard: Process Water |
| | 6 | 3 | 69.5 | 52.9 | 28.8 | 55.5 | 24.6 | 82.7 | 10.4 | 88.3 | Process Water |
| | 6 | 5 | 72.4 | 46 | 28.7 | 46.0 | 24.8 | 83.1 | 10.4 | 87.6 | |
| | 6 | 10 | 68.9 | 47.5 | 28.3 | 50.2 | 24.6 | 83.9 | 10.2 | 89.0 | |
| | 15 | 3 | 74.3 | 40.8 | 28.7 | 42 | 24.9 | 83.1 | 10.4 | 92.0 | |
| | 15 | 5 | 63.7 | 44.1 | 28.2 | 46 | 21.8 | 83.1 | 9.6 | 86.7 | |
| | 15 | 10 | 73.5 | 44.7 | 29.3 | 46.7 | 25.1 | 83.3 | 10.2 | 89.2 | |
| | 25 | 3 | 72.9 | 44.2 | 27.9 | 48 | 25.6 | 84.5 | 9.6 | 89.7 | |
| | 25 | 5 | 66.4 | 54.4 | 29.2 | 59.8 | 23.6 | 84.7 | 10.1 | 90.1 | |
| | 25 | 10 | 65.5 | 46.7 | 29 | 52.1 | 23.9 | 82.8 | 10.1 | 88.5 | |
| (C) | — | — | 186.3 | 53.5 | 20.5 | 14.6 | 41.2 | 63.2 | 17.4 | 66.0 | Standard: Local Water |
| | — | — | 160 | 69.8 | 16.2 | 13.4 | 42 | 82 | 11.5 | 42.4 | Standard: Process Water |
| | 6 | 3 | 116 | 46.8 | 28.2 | 24.6 | 26.5 | 64.2 | 16.9 | 88.5 | Process Water |
| | 6 | 5 | 167 | 53.9 | 18.7 | 76.4 | 33 | 70.5 | 16.2 | 94.3 | |
| | 6 | 10 | 78.8 | 56.8 | 21.8 | 24.3 | 20.5 | 83.3 | 15.5 | 97.3 | |
| | 15 | 3 | 54.5 | 35.7 | 16.1 | 19.7 | 16.1 | 19.7 | 15.1 | 96 | |
| | 15 | 5 | 110 | 58.7 | 26.3 | 44 | 26.3 | 44 | 16.6 | 97.4 | |
| | 15 | 10 | 84.4 | 67.8 | 25.9 | 36.1 | 25.4 | 88.4 | 16.1 | 97.3 | Process Water |
| | 25 | 3 | 18.1 | 53.1 | 22.2 | 24.6 | 53.5 | 88.1 | 15.7 | 97.4 | " |
| | 25 | 5 | 71.3 | 56 | 23 | 29.5 | 22.6 | 86.5 | 15.6 | 97.4 | " |
| | 25 | 10 | 117 | 74.2 | 24.8 | 25 | 25.1 | 90.6 | 17.0 | 97.2 | " |
| (D) | — | — | 109 | 46.9 | 32 | 57.5 | 53.2 | 86.2 | 14.5 | 98.4 | Standard Process Water |
| | 6 | 3 | 119 | 38.3 | 32.8 | 47.5 | 59.4 | 84.1 | 15.4 | 98.4 | Process Water Conditioning Time extension to 5 and 10 mins - same results |
| | 15 | 3 | 116 | 40.9 | 32.4 | 49.9 | 57.5 | 85.4 | 15.0 | 97.6 | Process Water: Extension to 5 and 10 mins - Same results |
| | 25 | 3 | 108 | 46.5 | 32.4 | 57.0 | 54.8 | 87.6 | 15.1 | 98.4 | Process Water - Extension to 5 and 10 mins - same results |
| (E) | — | — | 120 | 59.5 | 25.1 | 49.7 | 38.6 | 80.8 | 10.6 | 88.7 | Process Water |
| | 6 | 3 | 110 | 43.1 | 19.4 | 28.5 | 42.9 | 78.7 | 10.9 | 74.7 | Process Water: |
| | 15 | 3 | 84 | 36.6 | 12.1 | 17.9 | 34.1 | 75.1 | 8.4 | 63.0 | Process Water: |
| | 25 | 3 | 102 | 36.7 | 10.3 | 12.9 | 37.7 | 76.5 | 8.7 | 61.3 | As above |

| | CON 1 | | O/all Con | |
|---|---|---|---|---|
| ORE TYPE | Au | S | Au | S |
| (A) | Grade ↑ (2.7–23.7 $gt^{-1}$) Recovery ↑ (1.1–8.2%) | Grade ↑ (up to 1%) Recovery ↑ (2.4–9.1%) | Grade ↑ (up to 10.1 $gt^{-1}$) Recovery ↑ (up to 2.5%) | Grade ↑ (up to 0.5%) Recovery ↑ (up to 3.6%) |
| (B) | Grade ↑ (12.7–21.5 gt) | Grade ↑ (4.9–6.3%) | Grade ↑ (0.8–2.8 g/t) | Grade ↑ (0.3–1.19%) recovery ↑ (0.5–4.2%) |
| (C) | — | Grade ↑ (2–12%) Recovery ↑ (6–63%) | Recovery ↑ (4–8%) | Grade ↑ (3.6–5.5%) Recovery (46–55%) |

It will be noted that the sulphur recovery is an indirect measure of precious metals recovery as the precious metals are generally associated with the sulphur containing minerals in the ore.

It may be seen that improvement in precious metals recovery was obtained in pyrite, pyrrhotite and arsenopyrite flotation over conditions where no oxygen was introduced to the pulp during conditioning for A,B and C. For D, there was little difference. For E, arsenopyrite was depressed taking the bulk of precious metals, predominantly gold with it. Therefore, as iron sulphide: arsenopyrite ratio falls below about 2, or more particularly about 1.5, recovery of precious metals falls.

In some cases it may be desired to effect separation of pyrite from arsenopyrite and this may be done with oxygenation in association with a low iron sulphide:arsenopyrite ratio, less than approximately 2. The arsenopyrite sink product may then be treated for precious metals recovery.

The conditioning and flotation operations may be conducted at near neutral pH conditions with pH of the pulp generally between 7 and 8. Thus significant additions of pH modifying agents are not required in accordance with the invention.

It will be noted that the oxidising gas may be introduced in the milling stage above with possible advantage in terms of activation.

The above description is not limiting of the present invention and other variations may be developed by those skilled in the art upon a reading of this disclosure.

For example, the flotation operations may be implemented in a different manner than above described. Also, there exist many possible techniques for the recovery of the precious metals, which may include precious metals other than gold, from the sulphide concentrate by cyanide leaching or other operations.

The material treated may be a pyrite ore, especially where such contains precious metals but need not be an ore. For example a low grade concentrate or residue may be sourced from a mine and subjected to the process of the invention.

If desired, the flow rate and composition of the oxidising gas or gas mixture to the conditioning or flotation cells may be varied in accordance with measured electrochemical potential in the cell or ore or concentrate composition, especially with reference to the sulphur assay. Thus as sulphur assay increases, the flow rate of oxidising gas may increase or the composition of the gas varied to generate a higher proportion of oxidising gas. Gas composition may be varied in any desired manner, for example, the oxidising gas may further include a carrier gas which may be an inert or non-oxidising gas, the volume of the carrier gas being varied to provide an oxidising gas with composition that enables a desired range of oxidisation reduction potential or activation to be achieved in the pulp.

The flotation gas or oxidising gas, wherever introduced to the process, may be enriched in oxygen, e.g. oxygen enriched air. Oxygen enrichment or oxygen/ozone content may vary between the conditioning and flotation steps.

All such variations are considered to be within the scope of the present invention.

We claim:

1. A process for recovery of a precious metal containing mineral from a non-sulphide gangue mineral comprising:

preparing a pulp of a material containing the precious metal containing mineral and non-sulfide gangue mineral;

conditioning the pulp with an oxidizing gas having an oxygen and/or ozone content greater than air wherein the dissolved oxygen concentration in the pulp is maintained in the range 6 to 30 mg/l pulp; and subjecting the conditioned pulp to a flotation operation and selectively recovering the precious metal containing mineral as a float fraction of said flotation operation.

2. The process as claimed in claim 1, wherein the precious metal containing mineral is a sulphide mineral.

3. The process as claimed in claim 2, wherein the sulphide mineral is an iron sulphide.

4. The process as claimed in claim 3, wherein said iron sulphide is selected from the group consisting of pyrite, pyrrhotite and marcasite.

5. The process as claimed in claim 3, wherein at least a portion of iron in said sulphide is substituted with an element selected from the group consisting of arsenic, copper and nickel.

6. The process as claimed in claim 1, wherein base metal sulphides are present in said pulp.

7. The process as claimed in claim 1, wherein said precious metal containing mineral contains precious metals in a free state.

8. The process as claimed in claim 1, wherein said precious metal is contained in said precious metal containing mineral in a mineralized state.

9. The process as claimed in claim 1, wherein said non-sulphide gangue mineral is selected from the group consisting of siliceous minerals and carbonate minerals.

10. The process as claimed in claim 1, wherein said oxidizing gas is ozonated air or ozonated oxygen.

11. The process as claimed in claim 1, wherein said oxidizing gas further includes air.

12. The process as claimed in claim 1, wherein conditioning occurs prior to flotation.

13. The process as claimed in claim 1, wherein conditioning occurs simultaneously with flotation.

14. The process as claimed in claim 1, wherein conditioning is a multi-stage process.

15. The process as claimed in claim 1, wherein tail from said flotation operation is subjected to a further stage of conditioning with said oxidizing gas.

16. The process as claimed in claim 1, wherein conditioning with an oxidizing gas and conditioning with other flotation reagents occur in discrete conditioning stages.

17. The process as claimed in claim 1, wherein oxidizing gas is introduced during milling.

18. The process as claimed in claim 2, wherein oxidizing gas is introduced to said pulp in accordance with oxygen uptake rate of said precious metal containing mineral.

19. The process as claimed in claim 1, wherein oxidizing gas is introduced in accordance with either dissolved oxygen concentration or monitored pulp oxidation-reduction potential.

20. The process as claimed in claim 1, wherein addition of said oxidizing gas is controlled to maintain a desired range of dissolved oxygen concentration or pulp oxidation-reduction potential.

21. The process as claimed in claim 20, wherein said desired range of oxidation-reduction potential is determined for a specific ore type by trial and error.

22. The process as claimed in claim 1, wherein conditioning duration is less than 60 minutes.

23. The process as claimed in claim 22, wherein conditioning duration is less than 20 minutes.

24. The process as claimed in claim 23, wherein conditioning duration is 1 to 15 minutes.

25. The process as claimed in claim 1, wherein said pulp material contains a refractory precious metals containing ore.

26. The process as claimed in claim 1, wherein introduction of said oxidizing gas to said pulp is controlled in accordance with sulphur assay of said pulp.

27. The process as claimed in claim 1, wherein composition of said oxidizing gas is varied in accordance with monitored pulp electrochemical potential.

28. The process as claimed in claim 1, wherein said oxidizing gas further includes a carrier gas.

29. The process as claimed in claim 5, wherein iron is substituted with arsenic.

30. The process as claimed in claim 29, wherein arsenopyrite is recovered as a sink product during flotation.

31. The process as claimed in claim 1, wherein the majority of said oxidizing gas is oxygen.

32. The process as claimed in claim 1, wherein oxidizing gas is introduced on discharge of pulp from milling.

33. The process as claimed in claim 1, wherein oxidizing gas is introduced to the pulp prior to addition of other flotation reagents.

34. The process according to claim 12, further comprising introducing a second oxidizing gas into the flotation operation, the second oxidizing gas having an oxygen/ozone concentration different from the oxidizing gas introduced in the conditioning step.

* * * * *